United States Patent [19]

Noe

[11] Patent Number: 4,744,464

[45] Date of Patent: May 17, 1988

[54] RIBBON BLOWN GLASS ARTICLE TRANSPORT

[75] Inventor: Raymond J. Noe, Warren, Ohio

[73] Assignee: General Electric Company, Schenectady, N.Y.

[21] Appl. No.: 10,869

[22] Filed: Apr. 7, 1987

Related U.S. Application Data

[63] Continuation of Ser. No. 793,423, Oct. 31, 1985, abandoned.

[51] Int. Cl.[4] ..... B65D 85/42

[52] U.S. Cl. ..... 206/422; 206/419; 206/418; 206/499; 206/518; 53/446; D9/348

[58] Field of Search ..... 53/446, 447, 475; 206/418, 419, 420, 421, 422, 499, 562, 563, 564, 585, 588, 589, 427, 503, 515, 518; D9/341, 345, 347, 348

[56] References Cited

U.S. PATENT DOCUMENTS 2,893,550 7/1959 Sandmeyer ..... 53/447

*Primary Examiner*—David T. Fidei

*Attorney, Agent, or Firm*—Philip L. Schlamp; Edward M. Corcoran; J. F. McDevitt

[57] ABSTRACT

A transport tray for ribbon formed glass articles such as lamp glass envelopes and glass containers is disclosed which permits increased packing density to be achieved when the article containing trays are vertically stacked for shipment. The tray member comprises a flat sheet having cavities formed therein which partially enclose one side of the individual glass articles when inserted therein and with the location of said cavities being defined by at least one central row having the glass articles aligned alternately in opposite longitudinal directions, together with a row of said glass articles being located at each end of said central row wherein the individual glass articles are aligned in a longitudinal direction transverse to the longitudinal direction of the glass articles in said central row. These trays are thereafter stacked vertically whereby adjoining trays are rotated approximately 180° with respect to each other for the increased packing density.

23 Claims, 1 Drawing Sheet

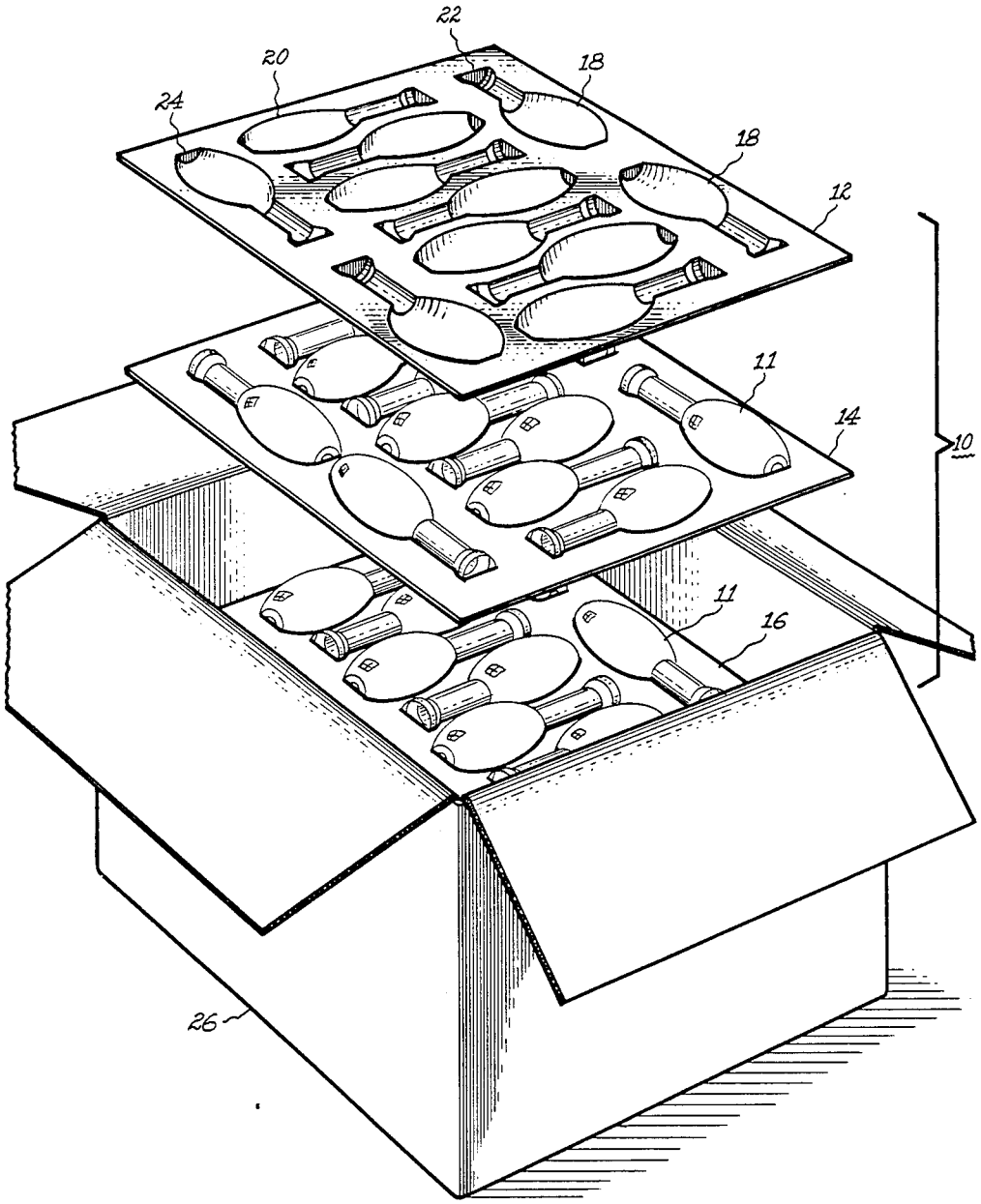
22
20
18
24
18
12
11
14
10
11
16
26

RIBBON BLOWN GLASS ARTICLE TRANSPORT

This is a continuation of application Ser. No. 793,423, filed Oct. 31, 1985, abandoned.

BACKGROUND OF THE INVENTION

Ribbon blown glass articles of various types such as lamp glass envelopes and glass containers are formed on a ribbon machine utilizing multi-part molds having a partible construction and which rotate while encircling a hollow molten glass blank. Said conventional molds further generally include a paste coating of the central mold cavity along with vent openings to form a steam cushion against which the glass article is blown while said mold parts are rotating. Said ribbon blown glass articles are also generally formed with a cylindrical neck portion terminating at one end in a larger diameter bulb having various shapes, including curved, cylindrical and conical contours as well as flat sides.

The present invention relates to a novel means for packaging these ribbon blown glass articles during transport in a manner avoiding excessive glass breakage often encountered by reason of the relatively thin wall construction of these articles, but at a greater packing density than now achieved with the conventional random packing practice. In said latter regard, these glass articles are now randomly placed in cartons, hampers and other type containers with such random orientation often producing large void spaces in the randomly packed arrangement which increases manufacturing costs. This drawback is especially significant when the conventionally packed glass articles are of a relatively large size so that a more space-efficient packing arrangement is desirable from this standpoint alone. It would also be desirable if such an improved transport packing arrangement is achieved in a manner avoiding physical contact between the individual glass articles after being packed as well as providing a packing means which lends itself to automatic loading and unloading.

Accordingly, an important object of the present invention is to provide a packing tray for the transport of ribbon blown glass articles which can be vertically stacked after said articles have been packaged therein at increased packing density.

Another important object of the present invention is to provide a novel stacked arrangement of these packed trays on various base supports which can thereafter be transported between manufacturing sites.

Still another important object of the present invention is to provide an improved method for transport packaging of ribbon formed glass articles which reduces other difficulties now being experienced with random packaging methods.

SUMMARY OF THE INVENTION

In accordance with the present invention, a novel transport tray for ribbon formed glass articles is provided which comprises a flat sheet having cavities formed therein which partially enclose one side of the individual glass articles when inserted therein, and with the location of said cavities being defined by at least one central row having the glass articles aligned alternately in opposite longitudinal directions together with a row of said glass articles being located at each end of said central row wherein the individual glass articles are aligned in a longitudinal direction transverse to the longitudinal direction of the glass articles in said central row so as to enable the vertical stacking of the flat sheets containing the glass articles in an arrangement whereby the adjoining sheets are rotated approximately 180° with respect to each other in the plane of said stacked sheets for increased packing density. As previously indicated, said glass articles can have various shapes as well as be formed by ribbon machine using either hard or soft glass.

In one preferred embodiment, said blown glass articles are lamp glass envelopes of relatively large size with an ovoid bulb shape and are packed in the present tray members to lie horizontally on one side when placed in the tray cavities. A preferred packaging assembly for said glass envelopes comprises a vertically stacked arrangement of flat sheets having cavities containing said glass envelopes which are further inserted into a box-shaped external carton of suitable size and shape. While the individual tray members constructed in accordance with the present invention can understandably be formed with various materials by conventional techniques, a preferred material of construction is molded plastic with the cavities being formed in the same contour and size as the blown glass articles packed therein.

The basic method of the present invention for transport packaging of ribbon formed glass envelopes at increased packing density thereby comprises:

(a) inserting the glass envelopes into cavities formed in the flat sheet which partially enclose one side of the individual glass envelopes, the location of said cavities in each sheet being defined by at least one central row having the glass envelopes aligned alternately in opposite longitudinal directions together with end rows of said glass envelopes being located at each end of said central row wherein the individual glass envelopes are aligned in a longitudinal direction transverse to the longitudinal direction of the glass envelopes in said central row, and (b) vertically stacking said glass envelope containing sheets on top each other such that adjoining sheets are rotated when stacked approximately 180° with respect to each other in the plane of said stacked sheets.

In a preferred form of said method, the vertically stacked glass envelope containing sheets are thereafter transported on a suitable base support such as a wooden pallet or plastic slip sheet, but can alternately be inserted into an external container such as a cardboard box for shipment. The present method further lends itself to stacking the loaded trays in direct physical contact with the adjoining tray below since the sheet material prevents physical contact between the packed articles.

BRIEF DESCRIPTION OF THE DRAWINGS

The accompanying drawing is a perspective view depicting an illustrative stacking configuration for transport of blown glass articles according to the present invention.

DESCRIPTION OF THE PREFERRED EMBODIMENTS

Referring to the accompanying drawing, there is depicted in perspective, a packaging assembly 10 for the improved transport of representative lamp glass envelopes 11. More particularly, transport tray members 12, 14 and 16 are formed with a physical configuration of cavity openings being disposed in a central row 20 with end rows 22 and 24, all as above previously described. Said tray members are first packed with said lamp glass envelopes 11 as depicted in said drawing for tray member 14. As can also be seen, the packed glass articles are deposited in said cavities to lie on one side with the unenclosed part of said envelopes protruding above the flat surface of the tray sheet. The packed tray members 14 and 16 are thereafter vertically stacked in an exterior carton 26 having a box-like configuration such that adjoining tray members are rotated when stacked approximately 180° with respect to each other in the horizontal plane defining the principal tray surface.

To illustrate the degree of improved packing density achievable with the above described embodiment, a comparison was made with the conventional random packaging of ED 28C type hard glass ribbon blown bulbs being shipped in a standard 45 foot long truck trailer. Said lamp glass envelopes are used in the manufacture of 400 watt size HPSV lamps and the conventional random packaging of said bulbs in a cardboard box packed 72 bulbs per box with 24 boxes being loaded on a wooden pallet for the truck shipment. As such, 384 boxes of the random packed bulbs filled this size truck for a total shipment of 27,648 bulbs per truck. The packaging of said bulbs in accordance with the above described embodiment resulted in 108 bulbs being loaded in a carton and 43,200 bulbs filling the same truck. Such improvement represents a 56% increase in packing density.

While a preferred embodiment of the transport packing assembly has been illustrated together with a representative method for its use, various other embodiments along with modifications in said method will become apparent to persons skilled in the art without departing from the true spirit and scope of the present invention. For example, it will be apparent from the foregoing description that said stacked tray members as above described can also be transported without an external container on a different base support such as a pallet or slip sheet. Accordingly, the scope of the present invention is limited only by the following claims.

What I claim is new and desire to secure by Letters Patent of the United States is:

1. A transport tray member for supporting, in a horizontal position, a plurality of articles having a shape generally defined by a cylindrical neck portion terminating in a larger diameter cylindrical or bulb portion, said tray comprising a flat sheet having cavities formed therein for at least partially enclosing one side of each of said individual articles to be supported by said tray, and with the location of said cavities being defined by at least one central row containing a plurality of said cavities aligned alternately in opposite longitudinal directions together with end rows containing a plurality of said article supporting cavities being located at each side of said central row, wherein said cavities in said end rows are aligned in a longitudinal direction transverse to the longitudinal direction of the cavities in said central row and further aligned in opposite direction with respect to each other in the same end row and in the opposite end row.

2. A tray member as in claim 1 having a single central row of said cavities.

3. A tray member as in claim 1 wherein said cavities are shaped so as to support articles having a cylindrical neck shape terminating at one end in a larger diameter bulb shape.

4. A tray member as in claim 1 wherein said cavities are shaped so as to support articles having a cylindrical neck portion terminating at one end in a larger diameter cylindrical shape.

5. A transport packing assembly for glass articles having a shape generally defined by a cylindrical neck portion terminating in a larger diameter cylindrical or bulb portion which comprises a stacked arrangement of flat sheet trays having cavities filled with said glass articles wherein said article filled sheets are stacked vertically such that adjoining sheets are rotated approximately 180° with respect to each other in the plane of said stacked sheets, each of said flat sheets having a plurality of glass article containing cavities formed to partially enclose one side of the individual glass articles when inserted therein, the location of said glass article containing cavities being defined by at least one central row containing a plurality of said glass articles aligned alternately in opposite longitudinal directions together with end rows of glass article containing a plurality of glass containing cavities being located at each side of said central row wherein the individual glass articles are aligned in a longitudinal direction transverse to the longitudinal direction of the glass articles in said central row and further aligned in opposite direction with respect to each other in the same end row and in the opposite end row, and with said stacked arrangement being further inserted into an external container.

6. An assembly as in claim 5 wherein the packed glass articles have a cylindrical neck portion terminating at one end in a larger diameter cylindrical shape.

7. An assembly as in claim 5 wherein the packed glass articles have a cylindrical neck portion terminating at one end in a larger diameter curved shape.

8. A method for transport packing of glass articles at increased packing density wherein said articles have a shape generally defined by a cylindrical neck portion terminating in a larger diameter cylindrical or bulb portion, said method comprising:

(a) inserting the glass articles into cavities formed in a flat sheet tray which at least partially enclose one side of each of the individual glass articles, the location of said cavities in each sheet being defined by at least one central row containing a plurality of said glass articles aligned alternately in opposite longitudinal directions together with end rows containing a plurality of said glass articles being located at the sides of said central row wherein the individual glass articles are aligned in a longitudinal direction transverse to the longitudinal direction of the glass articles in said central row and further aligned in opposite direction with respect to each other in the same row and in the opposite end row, and (b) vertically stacking said glass article containing sheets on top each other such that adjoining sheets are rotated when stacked approximately 180° with respect to each other in the plane of said stacked sheets.

9. A packing method as in claim 8 wherein the vertically stacked glass article containing sheets are thereafter placed on a base support.

10. A packing method as in claim 8 wherein the vertically stacked glass article containing sheets are thereafter inserted into an external container for transport.

11. A packing method as in claim 8 wherein said glass article filled sheets are stacked in direct physical contact therebetween such that the bottom side of an upper sheet rests directly upon the glass articles contained in a sheet stacked immediately below.

12. A packing assembly comprising a tray containing a plurality of cavities wherein each said cavity supports an article along the longitudinal direction of said article, said article having a shape generally defined by a cylindrical neck portion terminating in a larger diameter cylindrical or bulb portion, with the location of said article supporting cavities comprising at least one central row containing a plurality of said article supporting cavities sequentially aligned alternately in opposite longitudinal directions together with end rows comprising a plurality of said article supporting cavities being located at each side of said central row, wherein said article supporting cavities in said end rows are aligned in a longitudinal direction transverse to the longitudinal direction of the article supporting cavities in said central row and ruther aligned in opposite direction with respect to each other in the same end row and in the opposite end row, whereby a plurality of said assemblies may be stacked upon each other in an increased packing density by sequentially rotating such that adjacent assemblies are rotated about 180° with respect to each other to provide a stacking density greater than that which would be obtained if adjacent assemblies were not rotated about 180° with respect to each other.

13. The assembly of claim 12 wherein said tray is plastic.

14. The assembly of claim 12 wherein said supported articles have a cylindrical neck portion terminating in a larger diameter cylindrical shape.

15. The assembly of claim 12 wherein said supported articles have a cylindrical neck portion terminating in a larger diameter bulb shape.

16. The assembly of claim 14 having a single central row of said supporting cavities.

17. The assembly of claim 15 having a single central row of said supporting cavities.

18. The assembly of claim 12 wherein said article is a glass article.

19. The assembly of claim 13 wherein said article is a glass article.

20. The assembly of claim 14 wherein said article is a glass article.

21. The assembly of claim 15 wherein said article is a glass article.

22. The assembly of claim 16 wherein said article is a glass article.

23. The assembly of claim 17 wherein said article is a glass article.

* * * * *